US011123607B2

(12) United States Patent
Padgett

(10) Patent No.: US 11,123,607 B2
(45) Date of Patent: Sep. 21, 2021

(54) EXERCISE MANAGEMENT AND REPORTING SYSTEM

(71) Applicant: James Padgett, Saint Augustine, FL (US)

(72) Inventor: James Padgett, Saint Augustine, FL (US)

( * ) Notice: Subject to any disclaimer, the term of this patent is extended or adjusted under 35 U.S.C. 154(b) by 0 days.

(21) Appl. No.: 16/246,069

(22) Filed: Jan. 11, 2019

(65) Prior Publication Data

US 2020/0222760 A1 Jul. 16, 2020

(51) Int. Cl.
*A63B 24/00* (2006.01)

(52) U.S. Cl.
CPC ..... *A63B 24/0075* (2013.01); *A63B 24/0062* (2013.01); *A63B 24/0087* (2013.01); *A63B 2024/0078* (2013.01)

(58) Field of Classification Search
CPC ..... A63B 24/0078; A63B 24/0075; A63B 24/0087; A63B 24/0062; A63B 71/00; A63B 21/078
USPC ..... 482/1, 4, 7, 9
See application file for complete search history.

(56) References Cited

U.S. PATENT DOCUMENTS 2,113,899 A * 4/1938 Oram ..... A63B 69/0002 473/455
4,540,171 A * 9/1985 Clark ..... A63B 21/00181 482/106
5,048,826 A * 9/1991 Ryan ..... A63B 21/078 482/7
5,314,394 A * 5/1994 Ronan ..... A63B 21/0626 482/104
5,711,726 A * 1/1998 Powers ..... A63B 69/0002 473/453
6,558,299 B1 * 5/2003 Slattery ..... A63B 21/078 482/104
6,685,480 B2 * 2/2004 Nishimoto ..... G09B 19/0015 434/247
7,455,621 B1 * 11/2008 Anthony ..... A63B 21/0724 482/3
7,563,208 B1 * 7/2009 Chen ..... A63B 21/0728 482/108
7,666,118 B1 * 2/2010 Anthony ..... A63B 21/078 482/8
8,715,142 B1 * 5/2014 Leach ..... A63B 21/159 482/93
9,327,159 B1 * 5/2016 Medina ..... A63B 21/072
(Continued)

*Primary Examiner* — Gary D Urbiel Goldner
*Assistant Examiner* — Thao N Do
(74) *Attorney, Agent, or Firm* — Jason T. Daniel, Esq.; Daniel Law Offices, P.A.

(57) ABSTRACT

An exercise management and reporting system includes a weightlifting rack having a plurality of vertical members. Each of the vertical members include bar support brackets for receiving a barbell and weighted plate combination. Tracking sensors are positioned along the vertical members to track the movement of the barbell during an exercise. A control unit having a memory and wireless transmitter are provided along the rack. Weight sensors are positioned within each of the bar support brackets, and a wireless accelerometer is positioned along the barbell. The system also includes an exercise management application that receives the exercise data from the control unit and recommends and adjusts exercise workouts based on the received exercise data for each system user.

14 Claims, 4 Drawing Sheets

(56) References Cited

U.S. PATENT DOCUMENTS

| | | | | |
|---|---|---|---|---|
| 9,731,159 | B2 * | 8/2017 | Reynolds | A63B 21/0722 |
| 2002/0147081 | A1 * | 10/2002 | Slawinski | A63B 21/078<br>482/106 |
| 2005/0233871 | A1 * | 10/2005 | Anders | A63B 21/0724<br>482/93 |
| 2008/0119337 | A1 * | 5/2008 | Wilkins | A63B 21/4043<br>482/130 |
| 2014/0057764 | A1 * | 2/2014 | Klukas | A63B 21/072<br>482/109 |
| 2014/0248996 | A1 * | 9/2014 | Adel | G06Q 10/0639<br>482/8 |
| 2014/0369695 | A1 * | 12/2014 | D'Andrade | A63B 24/0021<br>398/162 |
| 2016/0144232 | A1 * | 5/2016 | Gardner | A63B 21/078<br>482/8 |
| 2016/0325141 | A1 * | 11/2016 | Wu | A63B 21/0628 |
| 2017/0043234 | A1 * | 2/2017 | Bourgeois | A63B 69/0091 |
| 2017/0209734 | A1 * | 7/2017 | Huang | A63B 22/0017 |
| 2017/0225038 | A1 * | 8/2017 | Wei | A63B 22/0242 |
| 2017/0246495 | A1 * | 8/2017 | Wyncott | A63B 21/0728 |
| 2017/0259106 | A1 * | 9/2017 | Pawlas | A63B 21/4035 |
| 2018/0064994 | A1 * | 3/2018 | Back | A63B 24/0087 |
| 2018/0169460 | A1 * | 6/2018 | Chen | A63B 21/075 |
| 2018/0214729 | A1 * | 8/2018 | Rubin | G16H 20/30 |

* cited by examiner

EXERCISE MANAGEMENT AND REPORTING SYSTEM

TECHNICAL FIELD

The present invention relates generally to exercise equipment, and more particularly to an exercise management and reporting system.

BACKGROUND

The statements in this section merely provide background information related to the present disclosure and may not constitute prior art.

When working with casual, student and/or professional athletes, strength training coaches often rely on weight lifting charts to create and guide client athletes toward successful results. In this regard, such charts often provide coaches with recommendations for specific weights and repetitions, based on the particular fitness, and characteristics of the athlete.

Once the recommendation is provided, the athlete must then complete the recommended course of exercises and chart the progress of each repetition. When working with free weights to perform major muscle exercises such as a bench press, or squats, for example, the athlete or coach must manually chart their progress. This includes the total number of successful repetitions at a specific weight, along with partial repetitions at a specific weight. Once finished, this information must be manually calculated to formulate a new chart for the athlete's next exercise routine.

In addition to the large amount of work such reporting procedures places onto a coach, the above process is often flawed by inaccurate reporting by the athlete and/or by simply forgetting to log the exercise results. Such a situation can significantly stunt the progress of an athlete over time, thereby resulting in less than optimal results.

Accordingly, it would be beneficial to provide an exercise management and reporting system that can provide athletes and coaches with real time data so as to alleviate the drawbacks described above.

SUMMARY OF THE INVENTION

The present invention is directed to an exercise management and reporting system. One embodiment of the present invention can include a weightlifting rack having a plurality of vertical members. Each of the vertical members can include bar support brackets for receiving a barbell and weighted plate combination. Sensors positioned along the vertical members can capture and track the movement of the barbell during an exercise. This movement and other exercise data can be stored in a memory of a control unit positioned along the weightlifting rack.

In one embodiment, weight sensors can be positioned within each of the bar support brackets and can be communicatively linked to the control unit. Additionally, the barbell can include an accelerometer that is in wireless communication with the control unit.

In one embodiment, the system can include an exercise management application which can receive the exercise data from the control unit. The exercise management application can include functionality for recommending and adjusting exercise workouts based on the received exercise data for each system user.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
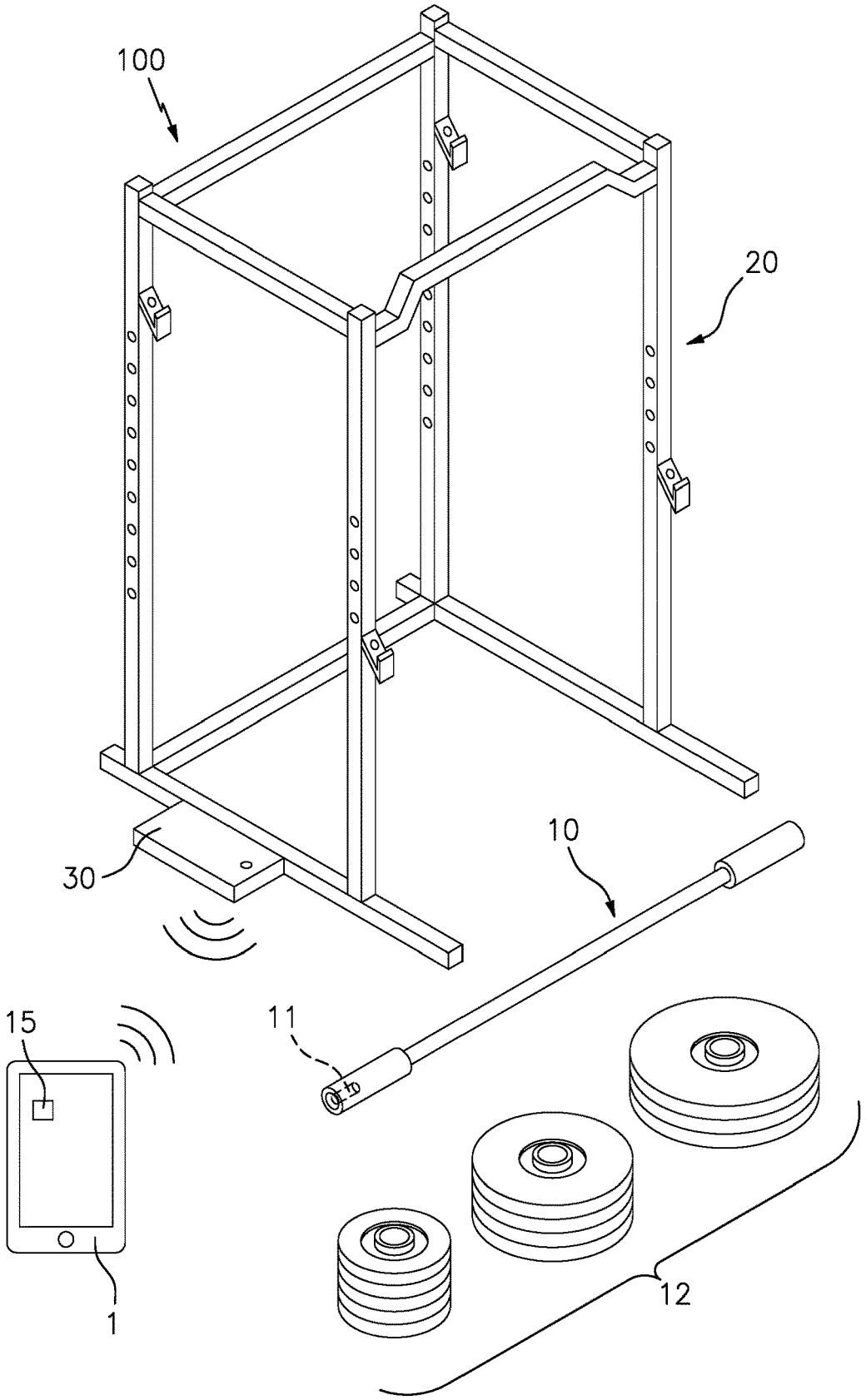
FIG. 1 is a perspective view of the exercise management and reporting system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material (i.e. Velcro®), magnets, and/or compression fittings such as a series of apertures and corresponding locking pins, clamps, nut/bolts, tethers (e.g., zip ties), snaps and/or buttons, for example.

Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

FIGS. 1-4 illustrate one embodiment of an exercise management and reporting system 100 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIG. 1, the system 100 can include a barbell 10 and a plurality of weighted plates 12, for use with a weightlifting rack 20 that can communicate with an external device running an exercise management application 15.

As described herein, the barbell 10 can include an elongated bar having any number of different shapes, lengths, and diameters suitable for engaging the central aperture of the weighted plate. In the preferred embodiment, the barbell will be constructed from steel; however, other construction materials are also contemplated.

In one embodiment, the barbell 10 can include an accelerometer sensor 11 that is preferably located along one end. As will be described below, the accelerometer 11 can function to detect and wirelessly transmit acceleration information of the barbell 10 to the control unit 30 of the weightlifting rack 20 during an exercise routine. One suitable example of an accelerometer sensor for use herein includes the coin cell powered MNS-9 accelerometer that is commercially available from Monnit®. Of course, any number of other components capable of performing the functionality described herein are also contemplated.

Although described and illustrated with regard to a single barbell, this is for illustrative purposes only. To this end, the system 100 can include any number of different types of barbell and dumbbell members having any number of different shapes and sizes. Moreover, it is contemplated that the accelerometer 11 can be removably secured onto a commercially available weightlifting bar, so as to allow the system to operate with any type of existing equipment.

The weighted plates 12 can include any number of commercially available items which are constructed from various different materials having a known total weight. The plates can be provided as a part of the overall system but, can also be acquired separate from the system. To this end, the plates can include any number of different shapes and diameters and can include a central aperture for engagement by the barbell 10. Weighted plates and barbells are extremely well known in the art; therefore, no further discussion will be provided.

Although described above as including an accelerometer that is positioned along the barbell and utilizing commercially available weighted plates, other embodiments are contemplated wherein one or more of the weighted plates can include an accelerometer sensor.

Figure 2:
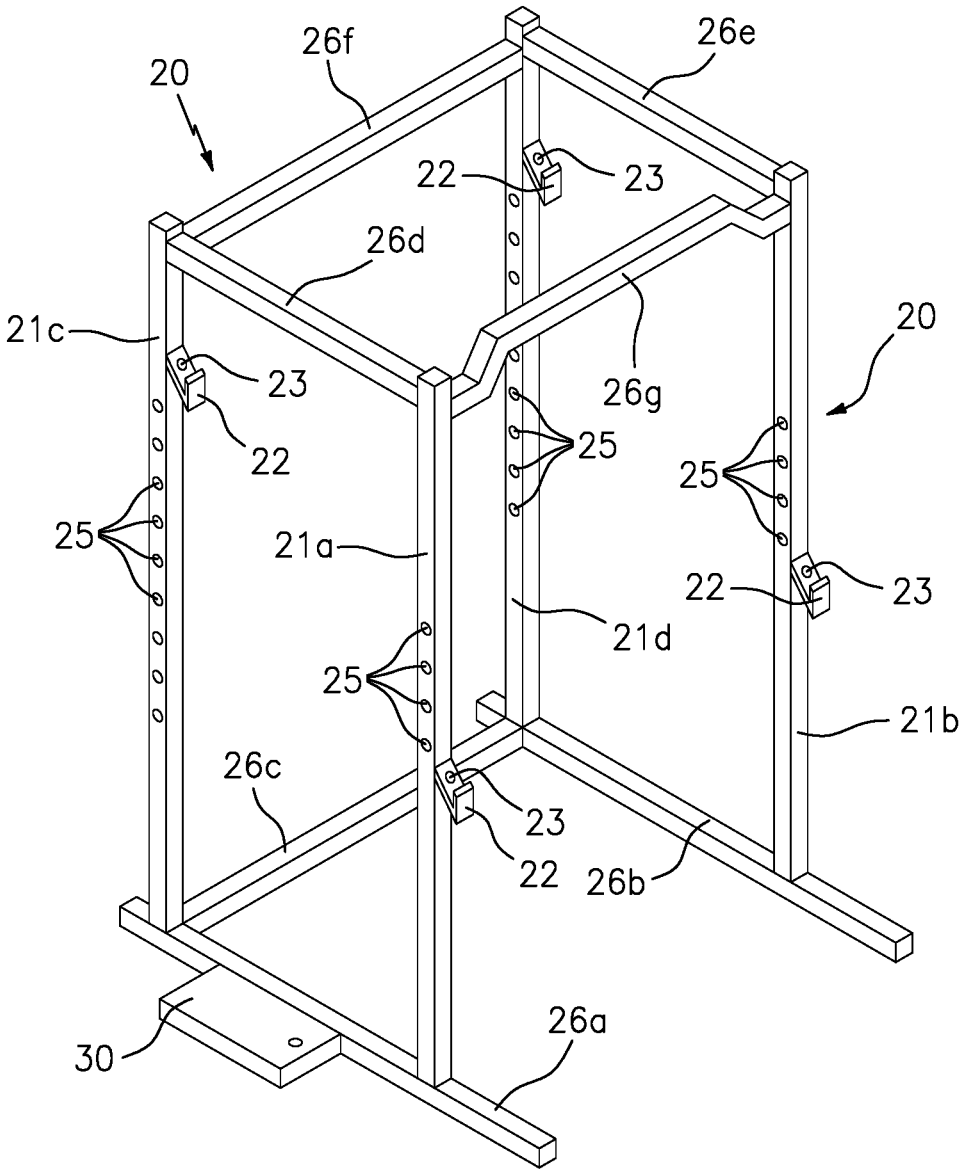
FIG. 2 is a perspective view of the weightlifting rack of the exercise management and reporting system in accordance with one embodiment of the invention.

FIG. 2 illustrates one embodiment of the weightlifting rack 20 that includes a plurality of vertical frame members 21*a*-21*d*, that define a longitudinal axis which extends vertically relative to the ground. Each of the frame members 21*a*-21*d* can preferably be constructed from steel tubing which is rectangular in cross section and can be connected together along the respective top and bottom ends by bracing elements 26*a*-26*g* to form a generally rectangular-shaped rack. Of course, other construction materials, shapes and sizes are also contemplated.

In one embodiment, each of the vertical frame members can include a bar support bracket 22 for receiving the barbell 10. As described herein, each of the support brackets 22 can include any number of different shapes, sizes and construction materials having a proximal end that is in communication with one of the frame members, and a distal end that extends outward from the respective frame member. In various embodiments, each of the support brackets can be permanently secured to the respective frame member or can be adjustably secured to the respective frame member via hardware (not illustrated) that allows the support bracket to be positioned anywhere along the length of a frame member.

In either instance, each of the support brackets 22 can include a load sensor 23 that is capable of detecting the weight of an object positioned on the support bracket. In the preferred embodiment, the load sensor can be positioned within the main body of the support bracket 22 so as to be flush with the top surface thereof. Such a feature is important to prevent the body of the weight sensor from interfering with how the bar rests within the support bracket, however other mounting locations are also contemplated. Each load sensor can be communicatively linked to the control unit 30.

One suitable example of a load sensor for use herein includes the FX19 compression load cell that is commercially available from TE connectivity; however, any number of other sensors capable of detecting and reporting the weight of an object are also contemplated.

In one embodiment, a plurality of tracking sensors 25 can be provided along the length of each of the frame members 21*a*-21*d*. Each of the tracking sensors can be arranged so that the sensor coverage area of one sensor ends where the sensor coverage area of an adjacent sensor begins. Such a feature ensures a continuous and uninterrupted area whereby the vertical movement of the exercise bar 10 is tracked as it moves up and down during an exercise routine.

In the preferred embodiment, each of the tracking sensors 25 can include a capacitive proximity sensor that is capable of independently detecting the bar 10 as it passes within the detection area of the sensor. Proximity sensors are preferred because they do not require a target sensor to be located within or along the object being tracked. However, the inventive concepts are not to be construed as limiting to a proximity sensor, as any number of other tracking sensors and associated systems are also contemplated. Several nonlimiting examples include infrared and optical motion detection sensors, magnetic detection sensors, and RFID sensors, for example.

The controller 30 can communicate with each of the sensors to receive and record exercise data, which can then be transmitted to an external device such as a computer or smartphone, for example. As described throughout this document, the term "exercise data" can include any form of information that can be captured by the system sensors during an exercise routine.

Several nonlimiting examples of exercise data which can be captured includes, but is not limited to, the total amount of weight being lifted, the number of successful repetitions, the number of partial repetitions, the acceleration of each repetition, the time per repetition, the time between each repetition and the overall time.

Figure 3:
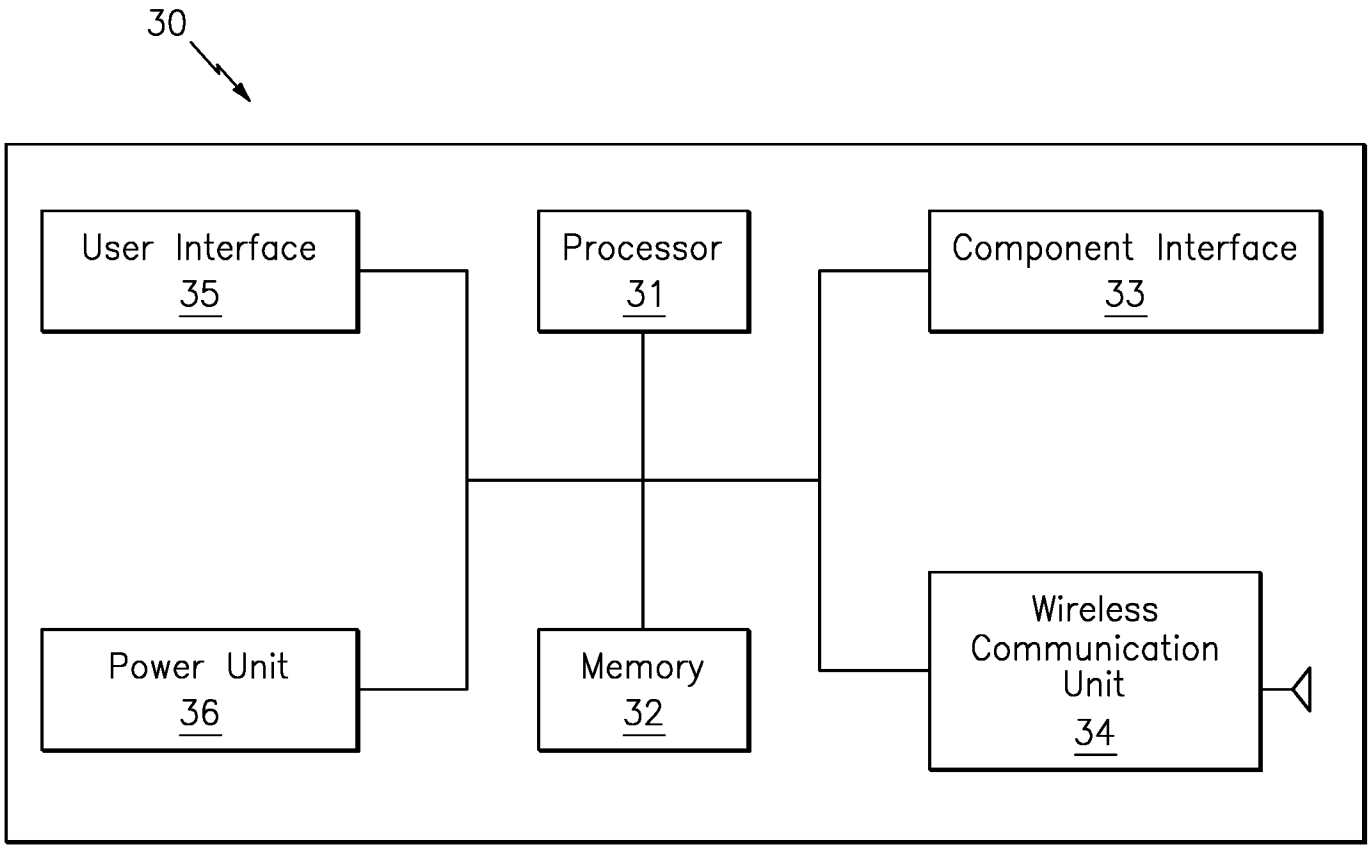
FIG. 3 is a simplified block diagram of the internal controller of the exercise management and reporting system in accordance with one embodiment of the invention.

FIG. 3 is a simplistic block diagram illustrating one embodiment of the control unit 30. As shown, the control unit can include a processing unit 31 that is conventionally connected to an internal memory 32, a component interface unit 33, a wireless communication unit 34, a user interface 35, and/or a power unit 36.

Although illustrated as separate elements, those of skill in the art will recognize that one or more system components may comprise or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the described functionality can be provided in place of, or in conjunction with the described elements.

The processing unit 31 can include one or more central processing units (CPU) or any other type of device, or multiple devices, capable of manipulating or processing information such as program code stored in the memory 32 in order to allow the device to perform the functionality described herein.

Memory 32 can act to store operating instructions in the form of program code for the processing unit 31 to execute. Although illustrated in FIG. 3 as a single component, memory 32 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. The bulk storage device can contain any number of different programs that permit the processor to perform the functionality described herein and can also receive and store the exercise information for each user.

The component interface unit 33 can function to provide a communicative link between the processing unit 31 and the system sensors 11, 23, and 25. In this regard, the component interface unit can include any number of different components such as one or more PIC microcontrollers, standard bus, internal bus, connection cables, wireless receiver and/or associated hardware such as USB cables and connectors, and other such hardware capable of linking the various components. Of course, any other means for providing the two-way communication between the system components can also be utilized herein.

The communication unit 34 can include any number of components capable of sending and/or receiving electronic signals with another device, either directly or over a network. In one preferred embodiment, the communication unit 34 can include a Bluetooth transceiver which can communicate with a remote computing device 1 through a mobile application (i.e., App) 15, for example, that can be downloaded onto the user device and installed as an application. Such a feature can allow a user or coach to receive and monitor the exercise data in real time and/or to wirelessly receive exercise data from the memory on demand.

Of course, the communication unit is not limited to the use of Bluetooth communication, as any number of other transmission and reception mechanisms are also contemplated.

The user interface 35 can include or comprise any number of physical components capable of sending and/or receiving information with a user. In one embodiment, the user interface can include one or more buttons/switches, for example, which can be located along the main body and connected to the processing unit 31 so as to activate different programmatic functions. For example, one such button can act to initiate programming for instructing the processing unit 31 to transition the device between an ON and OFF operating state, to initiate a sleep mode, to pair the communication unit 34 with an external device, and/or to designate different users who may be working out together.

The power unit 36 can include any number of different components capable of providing the necessary power requirements to each element of the system. To this end, the power source can include or comprise any number of different batteries and/or can include a common A/C electrical power transformer and cord capable of allowing the system to be powered from an electrical outlet.

In one embodiment, the system can include a traditional program or mobile application (App) 15 that can be installed on a smartphone or other processor enabled device and can function to send and/or receive information with the control unit 30. Of course, the inventive concepts disclosed herein are not to be construed as limiting to a smartphone App, as virtually any type of instruction sets, in any form of programming language that can be executed on a processor enabled device such as a computer or tablet, for example, are also contemplated.

Figure 4:
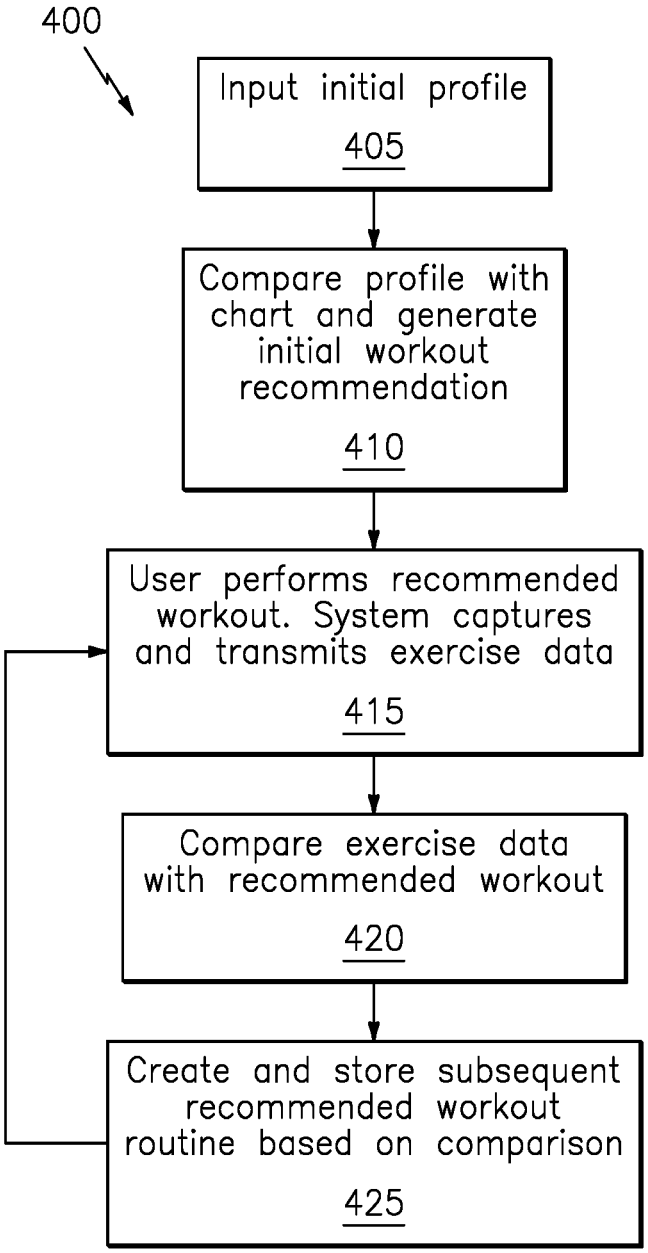
FIG. 4 is an exemplary method of using the exercise management and reporting system in accordance with one embodiment of the invention.

In either instance, the App 15 can include functionality for allowing an athlete or coach to utilize captured exercise data in order to plan and improve future workout routines. To this end, FIG. 4 illustrates an exemplary method 400 for maximizing exercise routines utilizing the rack and system described above.

The method can begin at step 405 in which a user or coach can input an initial profile of a user. This profile can include information such as the user's age, height weight, and BMI, for example.

Next, the method can proceed to step 410 wherein the initial profile is compared with a pre-loaded with exercise chart that can provide an initial recommendation for a specific workout including a plurality of exercises (e.g., bench press, squats, etc.,) number of repetitions and initial weights for each exercise.

Next, the method can proceed to step 415, wherein the user can perform the recommended workout utilizing the system 100, wherein the exercise data is captured and transmitted to the App 15.

Next, the method can proceed to step 420, wherein the exercise data is compared with the last recommended workout. Finally, at step 425 the method creates a subsequent recommended workout routine and store the same until the next query by the user whereby the initial recommendation will be replaced with the subsequent recommended workout routine.

For example, if the data shows the user was able to conduct 100 percent of a given exercise within a predetermined period of time and/or with an acceleration rate that exceeds a predetermined threshold, the subsequent recommended workout routine can include an increased weight amount or number of repetitions. Conversely, if a particular exercise is not successful, the subsequent recommended workout routine can include a decreased weight amount or number of repetitions.

Accordingly, the above described system, and method provide an exercise management and reporting system that can provide athletes and coaches with real time data to track and improve exercise results.

As described herein, one or more elements of the system 100 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but, is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An exercise management and reporting system, said system comprising:

an elongated exercise bar;

a weightlifting rack having a plurality of vertical frame members;

each of the plurality of bar support brackets being secured along one of the plurality of vertical frame members, respectively;

a plurality of tracking sensors that are positioned serially along each of the plurality of vertical frame members;

a control unit that is positioned along the weightlifting rack, said control unit being communicatively linked to each of the plurality of tracking sensors and including functionality for receiving and recording exercise data; and wherein each of the plurality of tracking sensors comprises a capacitive proximity sensor that is configured to detect and report the presence of the elongated exercise bar within a sensor area of the capacitive proximity sensor.

2. The system of claim 1, wherein each of the plurality of bar support brackets further includes a weight sensor that is communicatively linked with the control unit.

3. The system of claim 2, wherein each of the weight sensors is mounted flush with a top surface of each of the plurality of bar support brackets.

4. The system of claim 1, further comprising:

a bulk storage device that is located within the control unit and is configured to store the exercise data.

5. The system of claim 4, further comprising:

a wireless communication unit that is configured to transmit the exercise data to an external device.

6. The system of claim 5, wherein the wireless communication unit comprises a Bluetooth transceiver.

7. The system of claim 5, wherein the external device includes a smartphone running a mobile application.

8. An exercise management and reporting system, said system comprising:

an elongated exercise bar;

a weightlifting rack having a plurality of vertical frame members;

a plurality of bar support brackets, each of the plurality of bar support brackets being secured along one of the plurality of vertical frame members, respectively;

a plurality of tracking sensors that are positioned serially along each of the plurality of vertical frame members;

a control unit that is positioned along the weightlifting rack, said control unit being communicatively linked to each of the plurality of tracking sensors and including functionality for receiving, recording and transmitting exercise data;

an exercise management application that includes machine readable instructions for execution on a smartphone device, said exercise management application functioning to receive the transmitted exercise data from the control unit; and wherein each of the plurality of tracking sensors comprises a capacitive proximity sensor that is configured to detect and report the presence of the elongated exercise bar within a sensor area of the capacitive proximity sensor.

9. The system of claim 8, wherein the exercise management application includes functionality for recommending a specific workout based on the transmitted exercise data.

10. The system of claim 1, wherein each of the plurality of bar support brackets being secured directly with the one of the plurality of vertical frame members.

11. The system of claim 10, wherein each of the plurality of bar support brackets comprises a surface for directly supporting the elongated exercise bar.

12. The system of claim 1, wherein each of the plurality of bar support brackets extends from the one of the plurality of vertical frame members.

13. The system of claim 1, wherein the elongated exercise bar comprises an accelerometer configured to transmit acceleration information of the elongated exercise bar to the control unit.

14. The system of claim 2, wherein the weight sensors detect weight of the elongated exercise bar when the elongated exercise bar is placed on top of the plurality of bar support brackets.

* * * * *